US009748660B2

(12) United States Patent
Hwang et al.

(10) Patent No.: US 9,748,660 B2
(45) Date of Patent: Aug. 29, 2017

(54) ANTENNA WITH MULTIPLE FEED POINTS

(71) Applicant: HON HAI PRECISION INDUSTRY CO., LTD., New Taipei (TW)

(72) Inventors: Tzu-Yao Hwang, New Taipei (TW); Lung-Sheng Tai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 306 days.

(21) Appl. No.: 14/337,188

(22) Filed: Jul. 21, 2014

(65) Prior Publication Data

US 2015/0029071 A1 Jan. 29, 2015

(30) Foreign Application Priority Data

Jul. 24, 2013 (TW) ..... 102126390 A

(51) Int. Cl.
*H01Q 1/48* (2006.01)
*H01Q 9/42* (2006.01)
*H01Q 5/35* (2015.01)

(52) U.S. Cl.
CPC ..... *H01Q 9/42* (2013.01); *H01Q 5/35* (2015.01)

(58) Field of Classification Search
CPC ..... H01Q 9/04; H01Q 5/35
See application file for complete search history.

(56) References Cited

U.S. PATENT DOCUMENTS

2008/0143612 A1* 6/2008 Iwai ..... H01Q 1/243 343/702
2011/0025576 A1* 2/2011 Mao ..... H01Q 1/38 343/843
2015/0333396 A1* 11/2015 Tai ..... H01Q 1/48 343/905

FOREIGN PATENT DOCUMENTS

| | | |
|---|---|---|
| CN | 200997441 | 12/2007 |
| CN | 201060926 | 5/2008 |
| TW | 201001808 | 1/2010 |
| TW | M383213 | 6/2010 |

* cited by examiner

*Primary Examiner* — Trinh Dinh
(74) *Attorney, Agent, or Firm* — Wei Te Chung; Ming Chieh Chang

(57) ABSTRACT

An antenna includes a grounding portion extending in a longitudinal direction, a radiating portion extending in the longitudinal direction and parallel with the grounding portion, a connecting portion connecting the grounding portion and the radiating portion in a transverse direction perpendicular to the longitudinal direction and a coaxial cable. The coaxial cable comprises an inner conductor and an outer conductor surrounding the inner conductor, wherein the inner conductor comprises a first feed point connecting the connecting portion and a second feed point connecting the radiating portion, one part of the connecting portion is shortened serving as a shortened section between the first and second feed points.

20 Claims, 3 Drawing Sheets

ANTENNA WITH MULTIPLE FEED POINTS

BACKGROUND OF THE INVENTION

1. Field of the Invention

The present disclosure relates to an antenna, and more particularly to an antenna with multiple feed points.

2. Description of Related Art

With the development of technology, more and more portable electronic devices are equipped with wireless transceiver for transmitting wireless signals, so antenna is integrated therein. At present, the portable electronic devices upgrade quickly, the structure of the antenna in a new devices often has a little different from the old devices of the same series. As the same series of new and old devices has the substantially similar environment, the basic configuration of the antennas respectively therein are similar, only need to adjust the length of the signal path to reach the optimum state. However, a small change in structure needs a set of different molds for manufacturing. Therefore, various molds are needed which result in the rise of the manufacturing cost.

In view of the above, an improved antenna is desired to overcome the problems mentioned above.

SUMMARY OF THE INVENTION

Accordingly, an object of the present disclosure is to provide an antenna with multiple feed points so as to use in different devices for low cost.

According to one aspect of the present disclosure, an antenna with multiple feed points is provided. The antenna comprises a grounding portion extending in a longitudinal direction, a radiating portion extending in the longitudinal direction and parallel with the grounding portion, a connecting portion connecting the grounding portion and the radiating portion in a transverse direction perpendicular to the longitudinal direction and a coaxial cable. The coaxial cable comprises an inner conductor and an outer conductor surrounding the inner conductor, wherein the inner conductor comprises a first feed point connecting the connecting portion and a second feed point connecting the radiating portion, one part of the connecting portion is shortened serving as a shortened section between the first and second feed points.

Other objects, advantages and novel features of the disclosure will become more apparent from the following detailed description when taken in conjunction with the accompanying drawings, in which:

DETAILED DESCRIPTION OF THE INVENTION

Reference will now be made to the drawings to describe a preferred embodiment of the present disclosure in detail.

Figure 1:
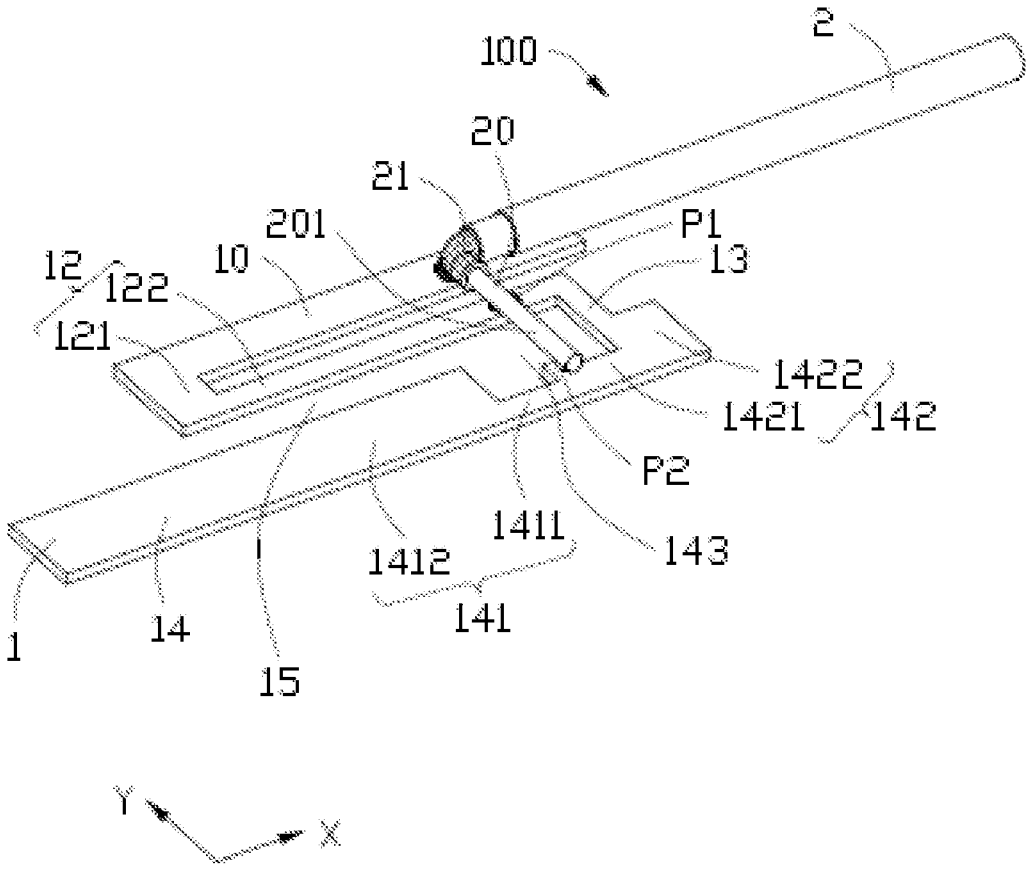
FIG. 1 is a perspective view of an antenna in accordance with a first embodiment of the present disclosure.

FIG. 1 shows a first embodiment of the present disclosure. An antenna 100 comprises a main body 1 and a coaxial cable 2 connecting the main body 1. The main body 1 comprises a plate like grounding portion 10 extending in a longitudinal/lengthwise direction defined as X direction. A connecting portion 12 is extended from the grounding portion 10. The connecting portion 12 is L-shaped, comprises a first section 121 extending in a transverse direction defined as Y direction perpendicular to the longitudinal direction and a second section 122 extending in the longitudinal direction. The second section 122 is parallel to the grounding portion 10. The grounding portion 10, the first section 121 and the second section 122 together form a U-shaped configuration. The main body 1 further comprises a shortened section 13 further extending from the second section 122 in the longitudinal direction and then extending in the transverse direction and far away from the grounding portion 10. A radiating portion 14 is extended from an end of the shortened section 13. The radiating portion 14 is parallel to the second section 122 of the connecting portion 12 and defining a slot 15 therebetween. The grounding portion 10, the connecting portion 12, the shortened portion 13 and the radiating portion 14 are in the same plane.

The coaxial cable 2 comprises an inner conductor 20 and an outer conductor 21 surrounding the inner conductor 20. The outer conductor 21 comprises a grounding point connecting the grounding portion 10 of the main body 1. The inner conductor 20 comprises a first feed point P1 connecting the second section 122 of the connecting portion 12 and a second feed point P2 extending from the first feed point P1 in the transverse direction and connecting the radiating portion 14. The inner conductor 20 between the first feed point P1 and the second feed point P2 is defined as a conducting section 201. The second feed point P2 divides the radiating portion 14 into a first part 141 working in a lower frequency band and a second part 142 working in a higher frequency band. The first part 141 successively comprises a first narrow section 1411 and a first wide section 1412. Similarly, the second part 142 successively comprises a second narrow section 1421 and a second wide section 1422. The radiating portion 14 further defines a cutout 143 facing said slot 15, and said second feeding point P2 is located adjacent to and directly faces said cutout 143.

The shortened section 13 locates between the first feed point P1 and the second feed point P2. One end of the shortened section 13 connects the first feed point P1, and another end connects the second part 142 of the radiating portion 14. The conducting section 201 of the inner conductor 20, the shortened section 13 and the second part 142 define a closed circuit. The length of the conducting section 201 is less than that of the shortened section 13. The first part 141, the conducting section 201 and the second section 122 of the connecting portion 12 is configured with U shape.

Figure 2:
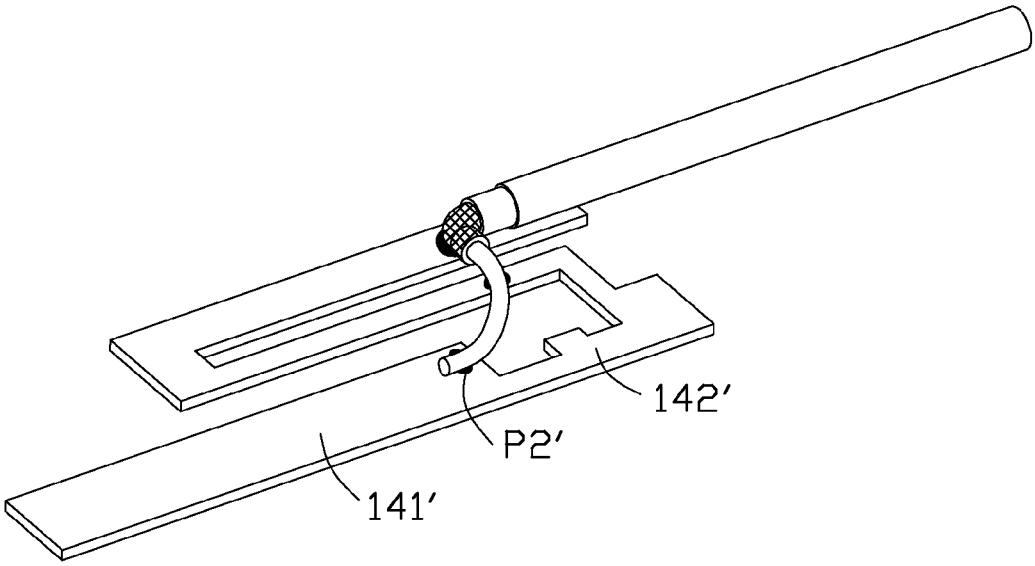
FIG. 2 is a perspective view of an antenna in accordance with a second embodiment of the present disclosure.
Figure 3:
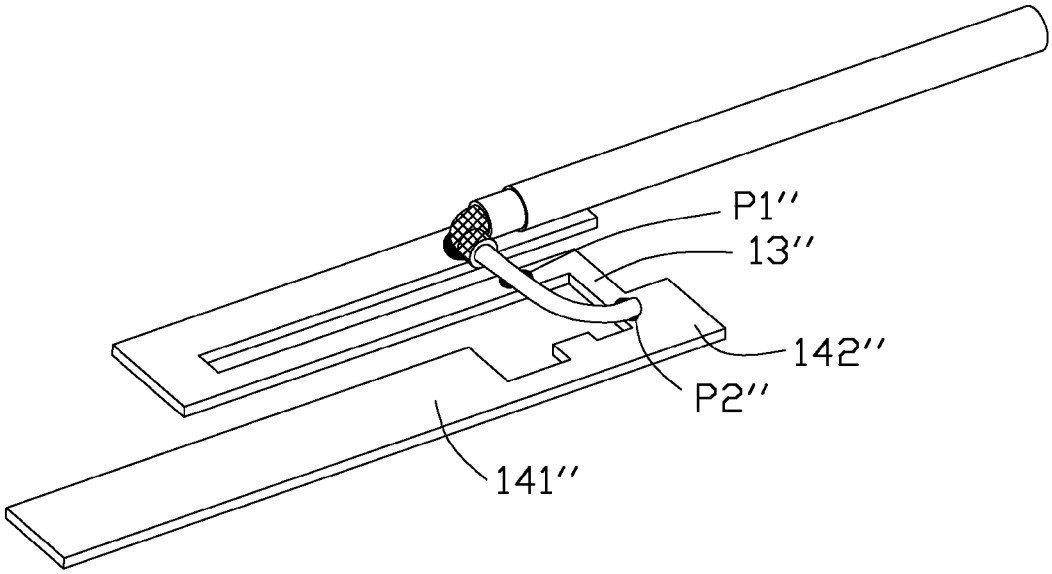
FIG. 3 is a perspective view of an antenna in accordance with a third embodiment of the present disclosure.

FIG. 2 is a second embodiment of the present disclosure. The difference between the second and first embodiments is: the second feed point P2' in the second embodiment is moved towards the first part 141' so as to adjust the length of the first and second parts 141', 142' of the radiating portion. FIG. 3 is the third embodiment of the present disclosure, wherein the second feed point P2" is moved towards the second part 142' to adjust the length of the first and second parts 141', 142' of the radiating portion. The shortened section 13" connects the first feed point and the second feed point at two opposite ends.

Any how, the antenna 100 of the present disclosure comprises at least two feed points, the signal is transmitted from the conducting section 201 between said two feed points, so that at least one section of the main body 1 is shortened, serving as a shortened section 13. Therefore, different signal transmitting paths can be achieved by adjusting the position of the feed point while the structure of the antenna main body does not need to be changed, so the antenna can be used in different products which result in low cost.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An antenna comprising:

a grounding portion extending in a longitudinal direction;

a radiating portion extending in the longitudinal direction and parallel with the grounding portion;

a connecting portion connecting the grounding portion and the radiating portion in a transverse direction perpendicular to the longitudinal direction; and a coaxial cable comprising an inner conductor and an outer conductor surrounding the inner conductor; and wherein the inner conductor comprises a first feed point connecting the connecting portion and a second feed point connecting the radiating portion, one part of the connecting portion is shortened serving as a shortened section between the first and second feed points;

wherein the connecting portion located between the grounding portion and the radiating portion in said transverse direction;

wherein the connecting portion comprises a first section connecting the grounding portion and a second section extending from the first section and perpendicular to the first section, the shortened section connects the second section of the connecting portion and the radiating portion;

wherein the second section of the connecting portion and the shortened section are located on two opposite sides of the second feed point in the longitudinal direction.

2. The antenna as claimed in claim 1, wherein the second feed point divides the radiating portion in a first part and a second part at two opposite sides of the second feed point in the longitudinal direction.

3. The antenna as claimed in claim 2, wherein the first part comprises a first narrow section and a first wide section successively from the second feed point, the second part comprises a second narrow section and a second wide section successively from the second feed point.

4. The antenna as claimed in claim 2, wherein the shortened section is L-shaped connecting the first feed point and the second part of the radiating portion at two opposite ends.

5. The antenna as claimed in claim 4, wherein the inner conductor between the first and second feed points is defined as a conducting section, and wherein the conducting section, the shortened section and the second part of the radiating portion define a closed circuit.

6. The antenna as claimed in claim 5, wherein the first part of the radiating portion, the conducting section of the inner conductor and the second section define a U shape.

7. The antenna as claimed in claim 6, wherein the shortened section connects the second section of the connecting portion and the second part of the radiating portion, and wherein the radiating portion, the shortened portion and the second portion define another U shape.

8. The antenna as claimed in claim 1, wherein the shortened section is L-shaped connecting the first feed point and the second feed point at two opposite ends.

9. The antenna as claimed in claim 1, wherein the radiating portion comprises a narrow section and a wide section, the second feed point is attached on the wide section.

10. An antenna comprising:

a main body, comprising a grounding portion, a radiating portion and a connecting portion connecting the grounding portion and the radiating portion; and a coaxial cable soldering on the main body, the coaxial cable comprising an outer conductor having a grounding point soldering on the grounding portion and an inner conductor having a first feed point soldering on the connecting portion and a second feed point soldering on the radiating portion; wherein the coaxial cable comprising a conducting section connecting the first feed point and the second feed point while the main body comprising a path connecting the first feed point and the second feed point, and wherein the length of the conducting section is less than the length of the path of the main body;

wherein the connecting portion located between the grounding portion and the radiating portion in a transverse direction;

wherein a slot is formed between the radiating portion and said connecting portion in the transverse direction, and the radiating portion defines a cutout facing said slot, and said second feeding point is located adjacent to and directly faces said cutout.

11. The antenna as claimed in claim 10, wherein the conducting section and the path of the main body define a closed circuit.

12. The antenna as claimed in claim 10, wherein the connecting portion comprising a second section extending from the first feed point in a longitudinal direction while the radiating portion comprising a first part extending from the second feed point in said longitudinal direction, and wherein the second section of the connecting portion, the first part of the radiating portion and the conducting section define a U shape.

13. The antenna as claimed in claim 10, wherein the grounding point, the first feed point and the second feed point are on the same line.

14. The antenna as claimed in claim 10, wherein the position of the second feed point can be changed along the radiating portion.

15. An antenna comprising:

a grounding portion and a radiating portion both extending along a lengthwise direction and spaced from each other in a transverse direction perpendicular to said lengthwise direction, and a connecting portion located between the grounding portion and the radiating portion in said transverse direction and having a first section mechanically and electrically connected to said grounding portion; and a coaxial cable including an outer conductor mechanically and electrically connected to the grounding portion, and an inner conductor defining a first feeding point mechanically and electrically connected to the connecting portion and a second feeding point mechanically and electrically connected to the radiating portion; wherein the connecting portion and the radiating portion are mechanically and electrically connected to each other via a shortened section, and the first section and the shortened section are respectively located by two opposite sides of the first feeding point in the lengthwise direction.

16. The antenna as claimed in claim 15, wherein the shortened section is located by a same side of the first feeding point and said second feeding point in the lengthwise direction.

17. The antenna as claimed in claim 15, wherein a slot is formed between the radiating portion and said connecting portion in the transverse direction, and the radiating portion defines a cutout facing said slot, and said second feeding point is located adjacent to and directly faces said cutout.

18. The antenna as claimed in claim 17 wherein said radiating portion forms a protrusion extending into the cutout, and said second feed point is located upon the protrusion.

19. The antenna as claimed in claim 17, wherein said second feeding point directly faces said cutout in the transverse direction.

20. The antenna as claimed in claim 15, wherein all said grounding portion, said radiating portion and said connecting portion are essentially parallel to one another.

* * * * *